US005321670A

United States Patent [19]

Rebeaud et al.

[11] Patent Number: 5,321,670

[45] Date of Patent: Jun. 14, 1994

[54] TIMEPIECE COMPRISING A ROTATABLE BEZEL

[75] Inventors: Jean-Philippe Rebeaud, Cressier; Beat Gilomen, Grenchen, both of Switzerland

[73] Assignee: Eta Sa Fabriques D'Ebauches, Grenchen, Switzerland

[21] Appl. No.: 53,252

[22] Filed: Apr. 28, 1993

[30] Foreign Application Priority Data

May 1, 1992 [CH] Switzerland ..... 01411/92

[51] Int. Cl.[5] ..... G04B 37/00

[52] U.S. Cl. ..... 368/291; 368/294

[58] Field of Search ..... 368/291-296, 368/21, 22

[56] References Cited

U.S. PATENT DOCUMENTS 4,067,186 1/1978 Grohoski et al. ..... 368/296

FOREIGN PATENT DOCUMENTS 0216420 4/1987 European Pat. Off. .

2513774 4/1983 France .

332558 10/1931 Switzerland .

376853 12/1963 Switzerland .

482237 11/1969 Switzerland .

631592 2/1983 Switzerland .

*Primary Examiner*—Vit W. Miska

*Attorney, Agent, or Firm*—Pollock, Vande Sande & Priddy

[57] ABSTRACT

A timepiece includes a case (2), a crystal (10) fixedly mounted on the case (2) and a rotatable bezel (16) guided in rotation relative to the crystal (10) and said case (2), said bezel (16) furthermore being associated with a ratchet mechanism (M) and is characterized in that said bezel (16) includes sealing means (36, 40) against solid impurities, such means being intended to isolate at least the ratchet mechanism (M) from the exterior and to prevent solid impurities from becoming embedded at least between said bezel (16) and the crystal (10) and in that it additionally includes means (24, 44) enabling the driving of such impurities towards the exterior of the timepiece.

12 Claims, 2 Drawing Sheets

TIMEPIECE COMPRISING A ROTATABLE BEZEL

The present invention concerns a timepiece including a rotatable bezel on which, for example, are inscribed time indications.

More specifically, it concerns a timepiece forming a wristwatch including a case as well as a crystal fixedly mounted on such case, and a rotatable bezel of the aforementioned type, guided in rotation relative to the crystal and to the case.

BACKGROUND OF THE INVENTION

Wristwatches provided with such a bezel are generally intended to be used for underwater diving and enable indication of a time period which has elapsed or remains to elapse. To this effect, the bezel cooperates with ratchet means which are mounted on the crystal and/or on the case and which permit a unidirectional rotational movement of the bezel as well as indexing of the latter into predetermined angular positions relative to the time-of-day display means of the watch.

The employment sphere of this type of wristwatch leads to the latter being frequently used in marine environments where are to be found numerous solid impurities, such as sand.

It has thus been determined that such solid impurities were very readily embedded between the bezel and the crystal as well as possibly between the bezel and the case, and could cause blocking of the rotating movement of the bezel or seriously damage the ratchet means.

The present invention thus has as purpose to overcome this drawback in providing a timepiece including a rotatable bezel which can be employed in every type of environment without having the presence of solid impurities come to hinder the operation of such bezel.

SUMMARY OF THE INVENTION

To this end, the present invention has as objective a timepiece including a case, a crystal fixedly mounted on the case and a rotatable bezel guided in rotation relative to the crystal and to said case, such bezel being furthermore associated with a ratchet mechanism characterized in that said bezel includes sealing means against solid impurities, such means being intended to isolate at least the ratchet mechanism from the exterior and to prevent solid impurities from becoming embedded at least between said bezel and the crystal and in that it further includes means enabling driving such impurities towards the exterior of the timepiece.

More specifically, this invention concerns a timepiece in which the crystal includes a lower part fixed to the case and an upper, so-called visualization part, visible from the exterior of the timepiece, characterized in that the sealing means include an annular groove formed between the upper part of the crystal and a corresponding upper part of the bezel, such groove being open and flared towards the exterior of said timepiece according to the invention.

It may also be specified that according to another characteristic the groove exhibits, in transversal cross-section, a basically truncated form.

But other characteristics and advantages of the present invention will appear more clearly upon reading the detailed description which follows, given by way of example and having reference to the attached drawings.

DESCRIPTION OF THE PREFERRED EMBODIMENTS

Figure 1:
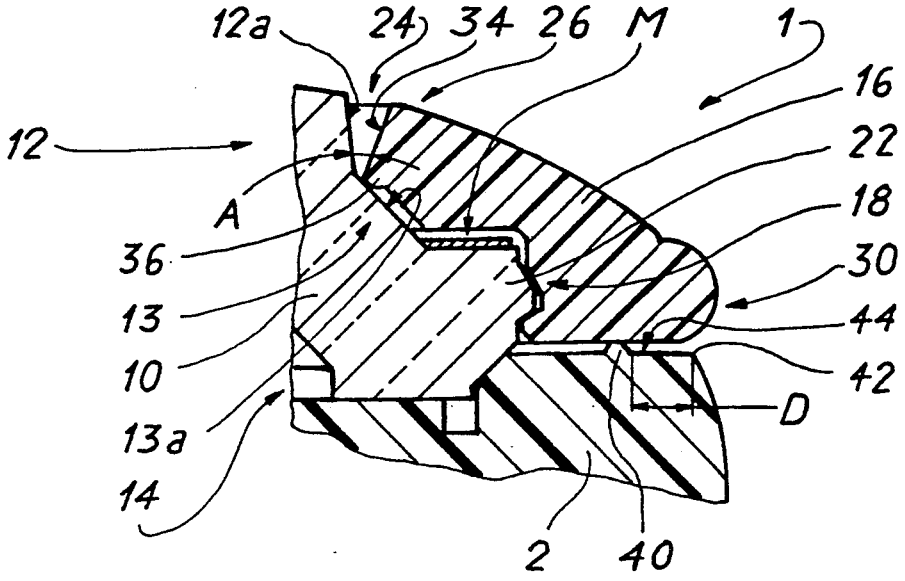
FIG. 1 is a partial cross-section view of a timepiece according to the invention.

Referring to FIG. 1, there will be described hereinafter a timepiece according to the invention, shown by the general reference 1.

The timepiece 1 includes a case 2 formed in this example of a plastic material in a standard manner.

Figure 2:
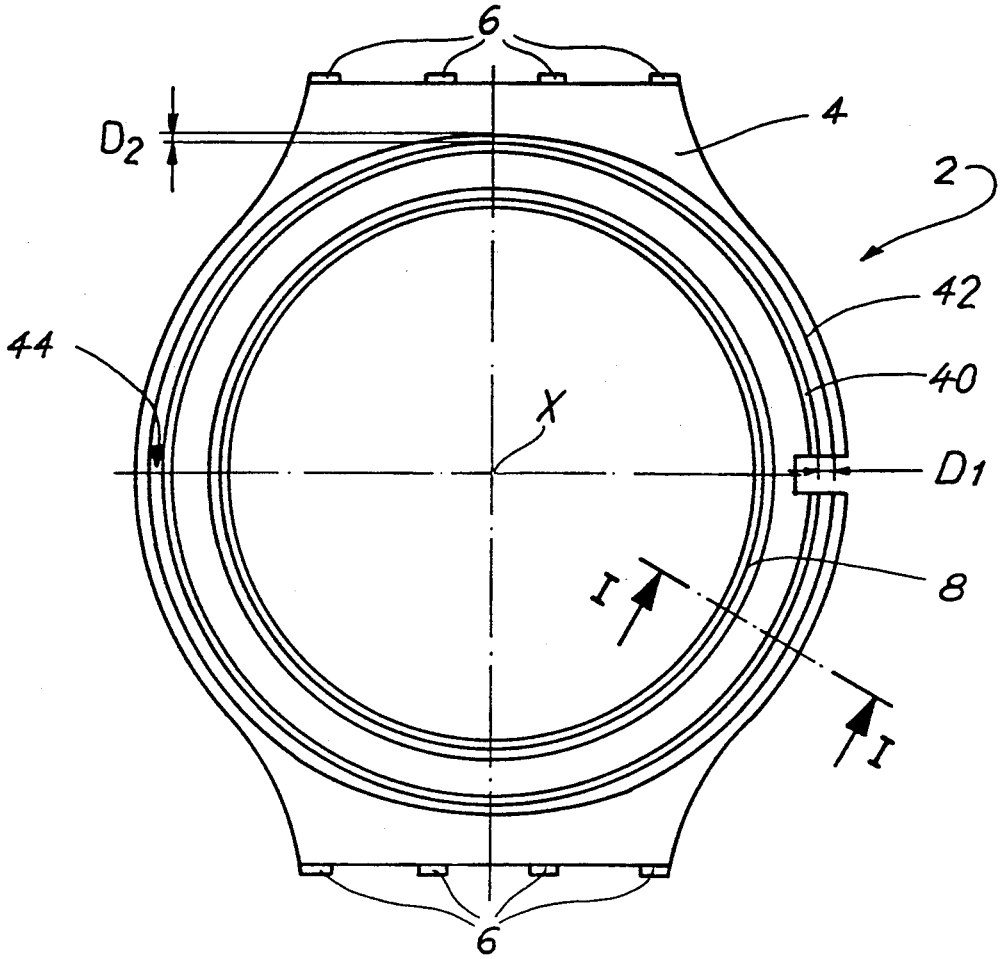
FIG. 2 is a top view of the case alone of the timepiece according to the invention.

Case 2 is shown in a more precise manner in the top view of FIG. 2.

Case 2 includes a caseband 4 on which are formed fastening lugs 6 intended to enable connection of the timepiece according to the invention with a bracelet, not shown.

Crystal 10 is fixedly mounted on case 2 by standard means, not shown, such as welding or gluing. The assembly, the fastening and positioning of the crystal 10 on case 2 being brought about in a standard manner and not forming part of the characteristics of the invention, will not be here explained in a detailed manner.

Crystal 10 thus exhibits an upper, so-called visualization, part 12 which is visible from the exterior of the timepiece 1 as is seen on FIG. 1 and the basic function of which is to enable a user to see the display means, not shown, through crystal 10.

Crystal 10 furthermore includes a lower part 14 which is fixed to case 2 as specified hereinbefore.

As is seen on FIG. 1, the timepiece 1 further includes a rotatable bezel 16 guided in rotation relative to the crystal 10 and relative to case 2 by rotational guide means represented by the general reference 18. The guide means 18 are of standard design and are made up here by a groove 20 (FIG. 3) formed directly in the rotatable bezel 16 and by a flange 22 itself formed directly in the lower part 14 of crystal 10. Thus, the assembly of the rotatable bezel 16 on crystal 10 is effected from the upper part 12 by elastic snapping of the bezel 16 onto flange 22 which comes to be housed in groove 20 exhibiting in cross-section a form corresponding to such flange.

The rotatable bezel 16 thus is seen to be axially maintained thanks to such guide means 20, 22 on the assembly crystal 10—case 2 and is also seen to be guided in rotation around the central axis X (FIG. 2) of the timepiece 1 according to the invention.

Here it will be specified that bezel 16 is formed of a plastic material such as a acrylonitrile butadiene styrene (ABS), so that such bezel exhibits sufficient elasticity enabling snapping onto crystal 10.

As is seen on FIG. 1, the timepiece 1 according to the invention further includes a ratchet mechanism M, here shown in a very schematic manner. Such mechanism which is of standard design and which does not form part of the invention is not here described in a more detailed manner.

Such a ratchet mechanism is described, for example, in Swiss patent 631,592.

Thus, it is understood that the rotatable bezel 16 may be displaced in rotation relative to crystal 10 and relative to case 2 in a unidirectional rotatable displacement around the central axis X of timepiece 1.

As is seen more specifically on FIG. 1, the rotatable bezel 16 further includes sealing means against solid impurities and means for ejecting such impurities in order to drive them towards the exterior of the timepiece, which means will be described in a more detailed manner hereinafter.

The ejection means include initially an annular groove 24 formed between the upper part 12 of the crystal 10 and a corresponding upper part 26 of bezel 16. It will be noted that within such upper part 26 is formed an orifice referred to as the upper orifice 28 (FIG. 3) defining a wall of groove 24 and into which the upper part 12 of crystal 10 comes for engagement therein.

Bezel 16 further includes a lower part 30 in which is defined a lower orifice 32 (FIG. 3) into which comes to be housed flange 22 formed on crystal 10.

Figure 3:
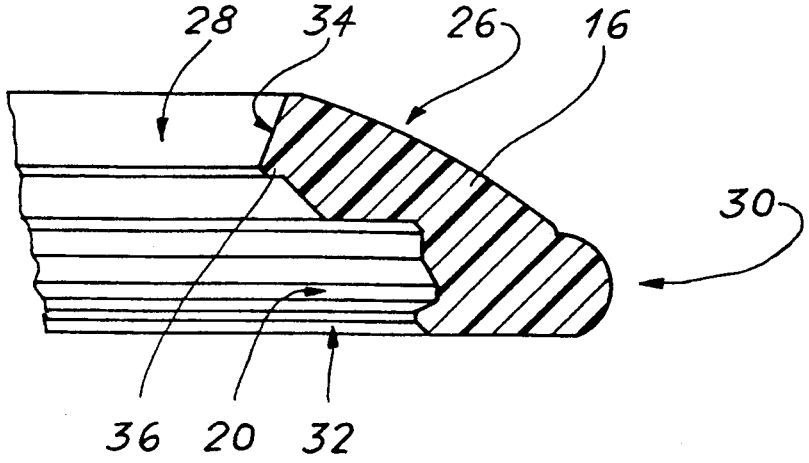
FIG. 3 is a transversal cross-section of a bezel shown on FIG. 1.

The annular groove 24 is more specifically made up by a bevel 34 formed directly on the upper part 26 of bezel 16, such bevel further giving to the orifice 28 which it defines a truncated form open towards the top (in the position of FIGS. 1 and 3).

Because of this, the annular groove 24 is open and flared towards the exterior of the timepiece 1. Groove 24 thus also exhibits in transversal cross-section, as is seen on FIG. 1, a basically truncated form.

More specifically, such annular groove 24 opens towards the exterior of timepiece 1 at an angle A at least greater than 5°, formed between the peripheral outer wall 12*a* of the upper part 12 of crystal 10 and the bevel 34 of bezel 16. Preferably the angle A exhibits a value comprised between 20° and 30°.

The annular groove 24 is terminated towards the bottom by sealing means formed by a sealing lip 36 which is in contact with crystal 10 and which enables isolating the ratchet mechanism M from the exterior of the timepiece according to the invention.

More specifically, lip 36 rests on an intermediate truncated part 13 of crystal 10 which intermediate part is formed by a wall 13*a* contiguous to the wall 12*a* of the upper part 12.

Thus, it is understood that solid impurities, here not shown, which come to be embedded in annular groove 24 cannot be stuck between the respective walls of crystal 10 and of the rotatable bezel 16 thanks to the sufficiently substantial space formed between such walls by the annular groove 24. At the first movement of the wrist by the wearer, not shown, the solid impurities found in groove 24 are driven to the exterior of the timepiece according to the invention.

Such solid impurities may no longer be interposed between the intermediate part 13 of crystal 10 and the corresponding interior wall of bezel 16 since the sealing lip 36 prevents all passage of such impurities.

It will here be noted that the sealing lip 36 is maintained in pressing contact on the corresponding wall 13*a* of crystal 10 since such sealing lip 36 forms the counter-bearing of bezel 16 on crystal 10, such bezel being placed under elastic tension on crystal 10 during its snap-on by the guide means 18. It will be noted to this effect that wall 13*a* is much more flared than wall 12*a* and thus presents, relative to the vertical, an angle greater than such wall 12*a*.

The timepiece 1 according to the invention further includes a second lip 40, this time formed between the lower part 30 of bezel 16 and case 2 and thus forming also part of the sealing means. More specifically, sealing lip 40 is formed directly on case 2 out of material common to the latter and is constituted by a rim (same reference) having a semi-circular form in cross-section extending, as is seen on FIG. 2, over the entire periphery of caseband 4 in a manner coaxial to axis X.

The lower part 30 of bezel 16 thus rests axially supported on the sealing lip 40 which itself also prevents the passage of solid impurities from the exterior towards crystal 10 and isolates the guide means of bezel 16 from the exterior.

In referring henceforth to FIG. 2, it will be noted that the sealing lip 40 is formed relative to an edge 42 forming the outer upper ridge of the caseband 4 at a distance D the value of which (referenced D1) along the time axis 3 o'clock 9 o'clock is greater than the distance (referenced D2) along the time axis 6 o'clock–12 o'clock.

Thus, it is noted that the second lip 40 is formed on case 2 at a distance from edge 42 of such case which diminishes in at least one sense around the central axis X of timepiece 1.

The lateral space between the second lip 40 and the edge 42 of case 2 forms a surface (and means) for ejecting solid impurities.

Such surface 44 shows in plan view (FIG. 2) a form having two crescents end to end which form enables driving out all solid impurities which should slide between the lower part 30 of the rotatable bezel 16 and case 2, since during the rotation given to bezel 16 the impurities arrive towards a region which diminishes to be practically zero at the 6 o'clock–12 o'clock axis and such impurities will fall over the side of caseband 4.

Figure 4:
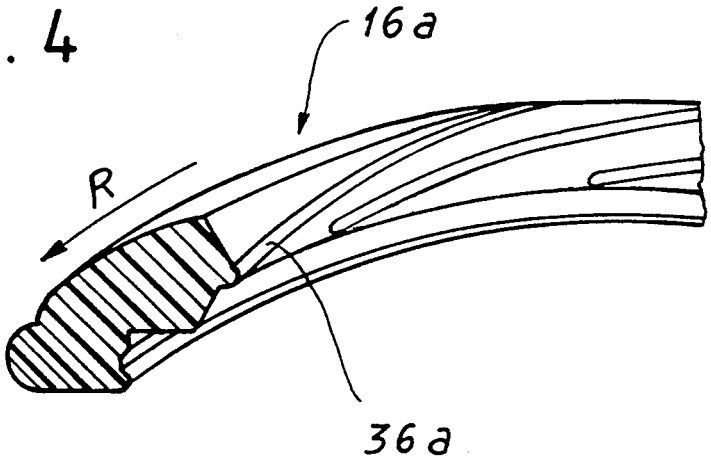
FIG. 4 is a partial view of a rotatable bezel according to a variant embodiment of the invention.

FIG. 4 shows another embodiment of a bezel 16*a* equipping the timepiece according to the invention.

Bezel 16*a* differs from bezel 16 in that it includes several sealing lips 36*a* (a single one being referenced) having a helical form.

Thus, during a rotational movement (arrow R) of bezel 16*a*, the solid impurities (not shown) climb along lips 36*a* so as to be ejected upwardly to the exterior.

What is claimed is:

1. A timepiece comprising a case, a crystal having a lower part fixed to the case and an upper visualization part visible from the exterior of the timepiece, a ratchet mechanism, and a rotatable bezel associated with said ratchet mechanism and guided in rotation relative to the crystal and to said case, said bezel including sealing means for isolating at least the ratchet mechanism from the exterior and preventing solid impurities from becoming embedded at least between said bezel and the crystal, said sealing means comprising an annular groove formed between the upper part of the crystal and an corresponding upper part of the bezel, said groove being open and flared towards the exterior of said timepiece and enabling driving such impurities towards the exterior of the timepiece.

2. A timepiece as set forth in claim 1, wherein said groove exhibits a transversal cross section of a basically truncated form.

3. A timepiece as set forth in claim 2, wherein said annular groove opens out towards the exterior of the timepiece with an angle A greater than 5°.

4. A timepiece as set forth in claim 3, wherein said angle A exhibits a value comprised between 20° and 30°.

5. A timepiece as set forth in claim 1, wherein said bezel exhibits at least one sealing lip in contact with the crystal.

6. A timepiece as set forth in claim 5, wherein said lip is formed at the base of the annular groove and rests on an intermediate truncated part of the crystal.

7. A timepiece as set forth in claim 1, including a so-called second sealing lip which is formed between a lower part of the bezel and the case and which permits isolating the guiding means for the bezel from the exterior of the timepiece.

8. A timepiece as set forth in claim 7 wherein said second lip is formed on the case at a distance from the edge of such case which diminishes in at least one sense around the central axis (X) of said timepiece.

9. A timepiece as set forth in claim 5, wherein said sealing lip has a helical form such that rotational movement of said bezel causes such solid impurities to climb along said helical sealing lip and be ejected upwardly towards the exterior of the timepiece.

10. A timepiece as set forth in claim 9, wherein said bezel exhibits a plurality of said helical sealing lips.

11. A timepiece as set forth in claim 6, wherein said sealing lip has a helical form such that rotational movement of said bezel causes such solid impurities to climb along said helical sealing lip and be ejected upwardly towards the exterior of the timepiece.

12. A timepiece as set forth in claim 11, wherein said bezel exhibits a plurality of said helical sealing lips.

* * * * *